US009670674B2

(12) United States Patent
St-Laurent et al.

(10) Patent No.: US 9,670,674 B2
(45) Date of Patent: Jun. 6, 2017

(54) CLIP ASSEMBLY FOR A SUSPENDED CEILING

(71) Applicant: LES PLAFONDS EMBASSY INC., Warwick (CA)

(72) Inventors: André St-Laurent, Laval (CA); Vincent Gendreau, Montréal (CA)

(73) Assignee: LES PLAFONDS EMBASSY INC., Warwick, Quebec (CA)

( * ) Notice: Subject to any disclaimer, the term of this patent is extended or adjusted under 35 U.S.C. 154(b) by 0 days.

(21) Appl. No.: 14/109,806

(22) Filed: Dec. 17, 2013

(65) Prior Publication Data

US 2015/0167297 A1 Jun. 18, 2015

(51) Int. Cl.

| | |
|---|---|
| ***E04B 9/18*** | (2006.01) |
| ***E04B 9/22*** | (2006.01) |
| ***E04B 9/24*** | (2006.01) |
| ***E04B 9/20*** | (2006.01) |
| *E04B 9/04* | (2006.01) |

(52) U.S. Cl.

CPC ..... *E04B 9/22* (2013.01); *E04B 9/18* (2013.01); *E04B 9/20* (2013.01); *E04B 9/24* (2013.01); *E04B 9/0464* (2013.01); *E04B 9/225* (2013.01)

(58) Field of Classification Search

CPC ..... E06B 9/06; E06B 9/18; E06B 9/20; E06B 9/22; E06B 9/24; E06B 9/26; E04B 9/06; E04B 9/18; E04B 9/20; E04B 9/22; E04B 9/24; E04B 9/26; E04B 9/225; E04B 9/245

See application file for complete search history.

(56) References Cited

U.S. PATENT DOCUMENTS

| | | | | |
|---|---|---|---|---|
| 1,726,500 | A * | 8/1929 | Norris | 52/145 |
| 2,059,483 | A * | 11/1936 | Parsons | 52/506.06 |
| 3,204,383 | A * | 9/1965 | Adams | 52/404.1 |
| 3,212,224 | A * | 10/1965 | Spangenberg | 52/506.08 |
| 3,263,388 | A * | 8/1966 | Bogert | 52/665 |
| 3,461,630 | A * | 8/1969 | Lovullo | 52/506.09 |
| 3,969,865 | A * | 7/1976 | Andersen | 52/506.07 |
| 5,611,185 | A * | 3/1997 | Wilz | 52/506.07 |
| 5,845,447 | A * | 12/1998 | Bodine et al. | 52/506.09 |
| 6,205,733 | B1 * | 3/2001 | LaLonde | 52/506.07 |
| 6,701,686 | B1 * | 3/2004 | Platt | 52/506.07 |
| 6,892,500 | B2 * | 5/2005 | Zaborowski | 52/506.06 |
| 8,745,946 | B2 * | 6/2014 | D'Alessandro et al. | 52/506.05 |

(Continued)

*Primary Examiner* — Andrew J Triggs
(74) *Attorney, Agent, or Firm* — PRAXIS IP; Franz Bonsang, Patent Agent

(57) ABSTRACT

A clip assembly for a suspended ceiling having a ceiling panel and a runner comprises a top member and a bottom member. The top member has an upper wall for being secured to an overhead structure and a pair of lower spaced apart lateral walls downwardly extending from the upper wall. The lateral walls comprise respective outer surfaces and inner surfaces defining a channel therebetween. At least one inward fin extends from each of the inner surfaces into the channel in an upwardly sloped direction. The bottom member comprises a bottom end for being secured to the runner and opposite lateral surfaces therebetween. At least one outward fin extends from each of the lateral surfaces in a downwardly sloped direction that is complementary to the upward sloped direction of the at least one inward fin. The bottom member is inserted into the channel.

13 Claims, 6 Drawing Sheets

(56) References Cited

U.S. PATENT DOCUMENTS

| | | | | |
|---|---|---|---|---|
| 2002/0112424 | A1* | 8/2002 | Zaborowski | 52/220.6 |
| 2003/0192268 | A1* | 10/2003 | Zaborowski | 52/220.6 |
| 2011/0072744 | A1* | 3/2011 | Maley et al. | 52/220.1 |
| 2012/0055109 | A1* | 3/2012 | Labonte et al. | 52/506.05 |
| 2014/0109505 | A1* | 4/2014 | St-Laurent et al. | 52/506.08 |

* cited by examiner

CLIP ASSEMBLY FOR A SUSPENDED CEILING

TECHNICAL FIELD

The present disclosure generally relates to ceilings. More particularly but not exclusively, the present disclosure relates to suspended ceilings. Still more particularly but still not exclusively, the present disclosure relates to a kit of parts adapted to be assembled to form a ceiling.

BACKGROUND

Suspended ceilings are usually made of a metal grid consisting of tracks in the form of longitudinal parallel runners spaced apart from one another at a desired distance and separated by cross members in a perpendicular fashion thereby creating a plurality of rectangular openings. In general, those rectangular openings are of standard sizes allowing the ventilation outlets and the lighting fixtures to be easily inserted among the ceiling panels.

Suspended ceilings have been mostly utilized in office buildings and in housing basements because of the handiness that such systems allow to repair and/or to modify the partition of the space. However, most development in suspended ceilings has been towards improving the convenience for offices, without any improvement to the visual aspect of the ceiling.

The art teaches a clip assembly for use with a suspended ceiling, having a first member adapted to be secured to an overhead structural member and a second member adapted to be connected to a runner adapted to support a ceiling tile or the like. The first and second members are connected together such that the runner can be suspended from the structural member via the clip assembly. The first member has a downwardly facing channel and the second member has a protrusion adapted to connectingly engage the channel.

OBJECTS

An object of the present disclosure is to provide a clip assembly for an a suspended ceiling.

An object of the present disclosure is to provide a suspended ceiling.

An object of the present disclosure is to provide a kit for constructing a suspended ceiling.

An object of the present disclosure is to provide a method for assembling a suspended ceiling.

SUMMARY

In accordance with an aspect of the disclosure, there is provided a clip assembly for a suspended ceiling, the suspended ceiling comprising at least one ceiling panel and at least one runner, the clip assembly comprising: a top member having an upper wall for being secured to an overhead structure and comprising a pair of lower spaced apart lateral walls downwardly extending from the upper wall, the lateral walls defining front and rear open faces and a bottom opening and comprising respective outer surfaces and inner surfaces defining a channel therebetween, at least one inward fin extending from each of the inner surfaces into the channel in an upwardly sloped direction; and a bottom member comprising a top end, a bottom end for being secured to the runner and opposite lateral surfaces therebetween, at least one outward fin extending from each of the lateral surfaces in a downwardly sloped direction that is complementary to the upward sloped direction of the at least one inward fin, wherein the bottom member is configured to be inserted into the channel via the front or rear open faces providing for each one of the outward fins to slide on a respective one of the inward fins and be supported thereon and for the bottom end to extend below the bottom opening thereby mounting the bottom member to the top member so as to connect the runner when the bottom end is secured thereto to the overhead structure when the upper wall is secured thereto.

In accordance with an aspect of the disclosure, there is provided a suspended ceiling comprising: a plurality of runners for being mounted to an overhead structure; a plurality of panels for being mounted to the plurality of runners; and at least one clip assembly for mounting at least one of the runners to the overhead structure, the at least one clip assembly comprising: a top member having an upper wall for being secured to the overhead structure and comprising a pair of lower spaced apart lateral walls downwardly extending from the upper wall, the lateral walls defining front and rear open faces and a bottom opening and comprising respective outer surfaces and inner surfaces defining a channel therebetween, at least one inward fin extending from each of the inner surfaces into the channel in an upwardly sloped direction; and a bottom member comprising a top end, a bottom end for being secured to the at least one runner and opposite lateral surfaces therebetween, at least one outward fin extending from each of the lateral surfaces in a downwardly sloped direction that is complementary to the upward sloped direction of the at least one inward fin, wherein the bottom member is configured to be inserted into the channel via the front or rear open faces providing for each one of the outward fins to slide on a respective one of the inward fins and be supported thereon and for the bottom end to extend below the bottom opening thereby mounting the bottom member to the top member so as to connect the at least one runner when the bottom end is secured thereto to the overhead structure when the upper wall is secured thereto.

In accordance with an aspect of the disclosure, there is provided a kit for a suspended ceiling comprising, the kit comprising: at least a pair of runners for being mounted to an overhead structure; at least one panel for being mounted to the pair of runners; and at least one clip assembly for mounting at least one of the runners of the pair to the overhead structure, the at least one clip assembly comprising: a top member having an upper wall for being secured to the overhead structure and comprising a pair of lower spaced apart lateral walls downwardly extending from the upper wall, the lateral walls defining front and rear open faces and a bottom opening and comprising respective outer surfaces and inner surfaces defining a channel therebetween, at least one inward fin extending from each of the inner surfaces into the channel in an upwardly sloped direction; and a bottom member comprising a top end, a bottom end for being secured to the at least one of the runners of the pair and opposite lateral surfaces therebetween, at least one outward fin extending from each of the lateral surfaces in a downwardly sloped direction that is complementary to the upward sloped direction of the at least one inward fin, wherein the bottom member is configured to be inserted into the channel via the front or rear open faces providing for each one of the outward fins to slide on a respective one of the inward fins and be supported thereon and for the bottom end to extend below the bottom opening thereby mounting the bottom member to the top member so as to connect the at least one of the runners of the pair when the bottom end is secured thereto to the overhead structure when the upper wall is secured thereto.

In an embodiment, the bottom end comprises an insertion for being secured within a groove formed on a surface of the runner.

In an embodiment, each of the lateral surfaces of the bottom ember comprises at least one flexible and resilient curved flap member downwardly extending therefrom each and defining a respective free end thereof for engaging runner when the bottom end is secured thereto thereby stabilizing the clip assembly between the overhead structure and the runner.

In an embodiment, the upper wall comprises a top surface for interfacing with the overhead structure, the top surface defining a peripheral edge and comprising a flexible and resilient flap inwardly extending from the peripheral edge for engaging the overhead structure to bias the upper wall away from the overhead structure when secured thereto.

In an embodiment, the upper wall is fastened to the overhead structure.

In an embodiment, the top end comprises an outer top flexible and resilient curved wall, the upper wall comprising an undersurface defined between the spaced apart lower lateral walls, the outer top curved wall providing for engaging the undersurface.

In an embodiment, the inner surfaces of the lower lateral walls comprise a plurality of inward fins and outward fins, each of the plurality of inward fins positioned at a respective height along the vertical length of the channel, each of the outward fins positioned at a respective height along the vertical length of the bottom member, thereby providing for mounting the bottom member at different heights along the vertical length of the top member.

In accordance with an aspect of the disclosure, there is provided a method of constructing a suspended ceiling, the method comprising: providing a plurality of runners for being mounted to an overhead structure; providing a plurality of panels for being mounted to the plurality of runners; providing at least one clip assembly for mounting at least one of the runners of the pair to the overhead structure, the at least one clip assembly comprising: a top member having an upper wall for being secured to the overhead structure and comprising a pair of lower spaced apart lateral walls downwardly extending from the upper wall, the lateral walls defining front and rear open faces and a bottom opening and comprising respective outer surfaces and inner surfaces defining a channel therebetween, at least one inward fin extending from each of the inner surfaces into the channel in an upwardly sloped direction; and a bottom member comprising a top end, a bottom end for being secured to the at least one of the runners of the pair and opposite lateral surfaces therebetween, at least one outward fin extending from each of the lateral surfaces in a downwardly sloped direction that is complementary to the upward sloped direction of the at least one inward fin; securing the upper wall to the overhead structure; inserting the bottom member into the channel via the front or rear open faces by sliding each one of the outward fins on a respective one of the inward fins and positioning the outward fins on the inward fins to be supported thereon and for the bottom end to extend below the bottom opening thereby mounting the bottom member to the top member; and securing the bottom end to the at least one runner thereby connecting the at least one runner to the overhead structure.

Other objects, advantages and features of the present disclosure will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Generally stated, the disclosure provides a clip assembly for a suspended ceiling comprising a top member and a bottom member. The suspended ceiling comprises at least one ceiling panel and at least one runner. The top member has an upper wall for being secured to an overhead structure and comprises a pair of lower spaced apart lateral walls downwardly extending from the upper wall. The lateral walls define front and rear open faces and a bottom opening and comprise respective outer surfaces and inner surfaces defining a channel therebetween. At least one inward fin extends from each of the inner surfaces into the channel in an upwardly sloped direction. The bottom member comprises a top end, a bottom end for being secured to the runner and opposite lateral surfaces therebetween. At least one outward fin extends from each of the lateral surfaces in a downwardly sloped direction that is complementary to the upward sloped direction of the at least one inward fin. The bottom member is configured to be inserted into the channel via the front or rear open faces providing for each one of the outward fins to slide on a respective one of the inward fins and be supported thereon and for the bottom end to extend below the bottom opening thereby mounting the bottom member to the top member so as to connect the runner when the bottom end is secured thereto to the overhead structure when the upper wall is secured thereto.

With reference to the Figures, non-limiting illustrative embodiments will now be described.

Figure 1:
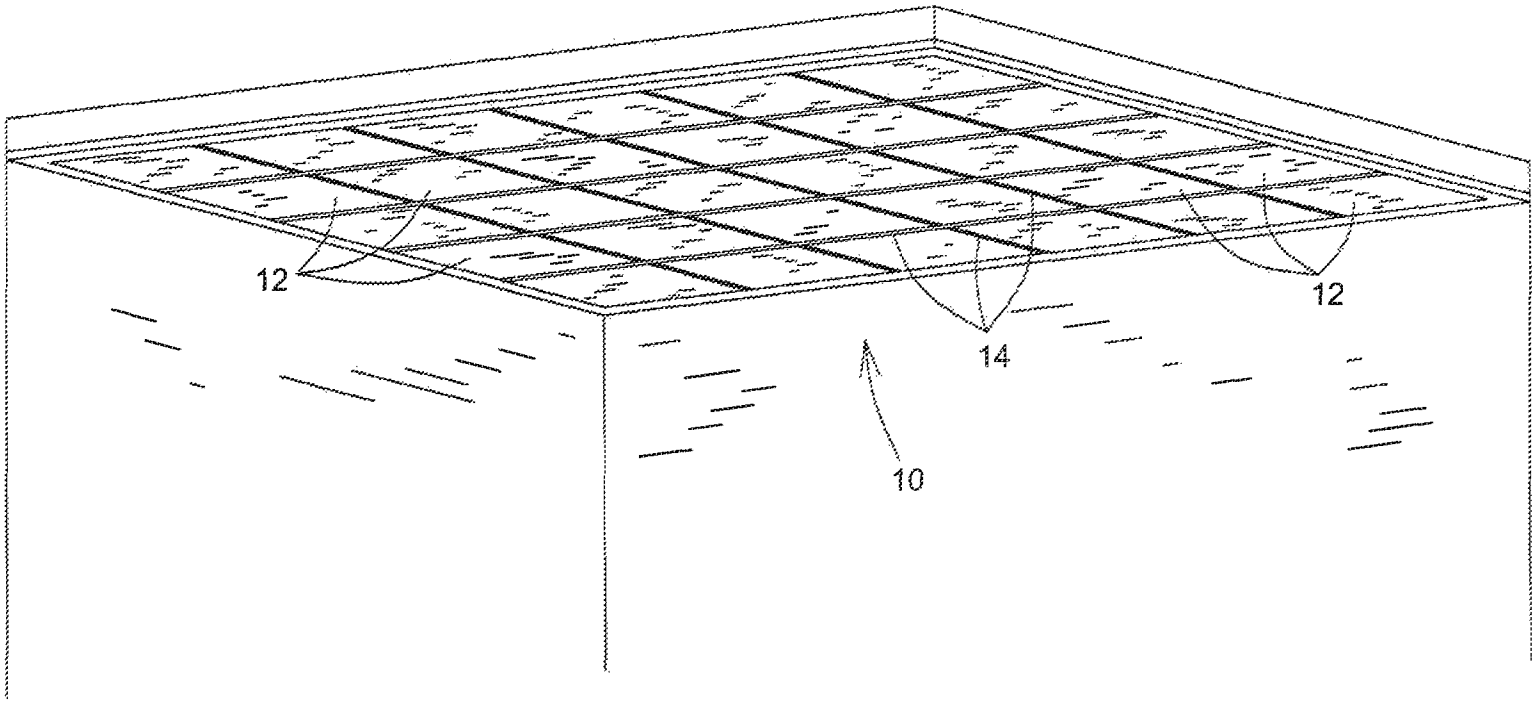
FIG. 1 is a bottom perspective view of an assembled suspended ceiling in accordance with a non-limiting illustrative embodiment of the present disclosure.
Figure 2:
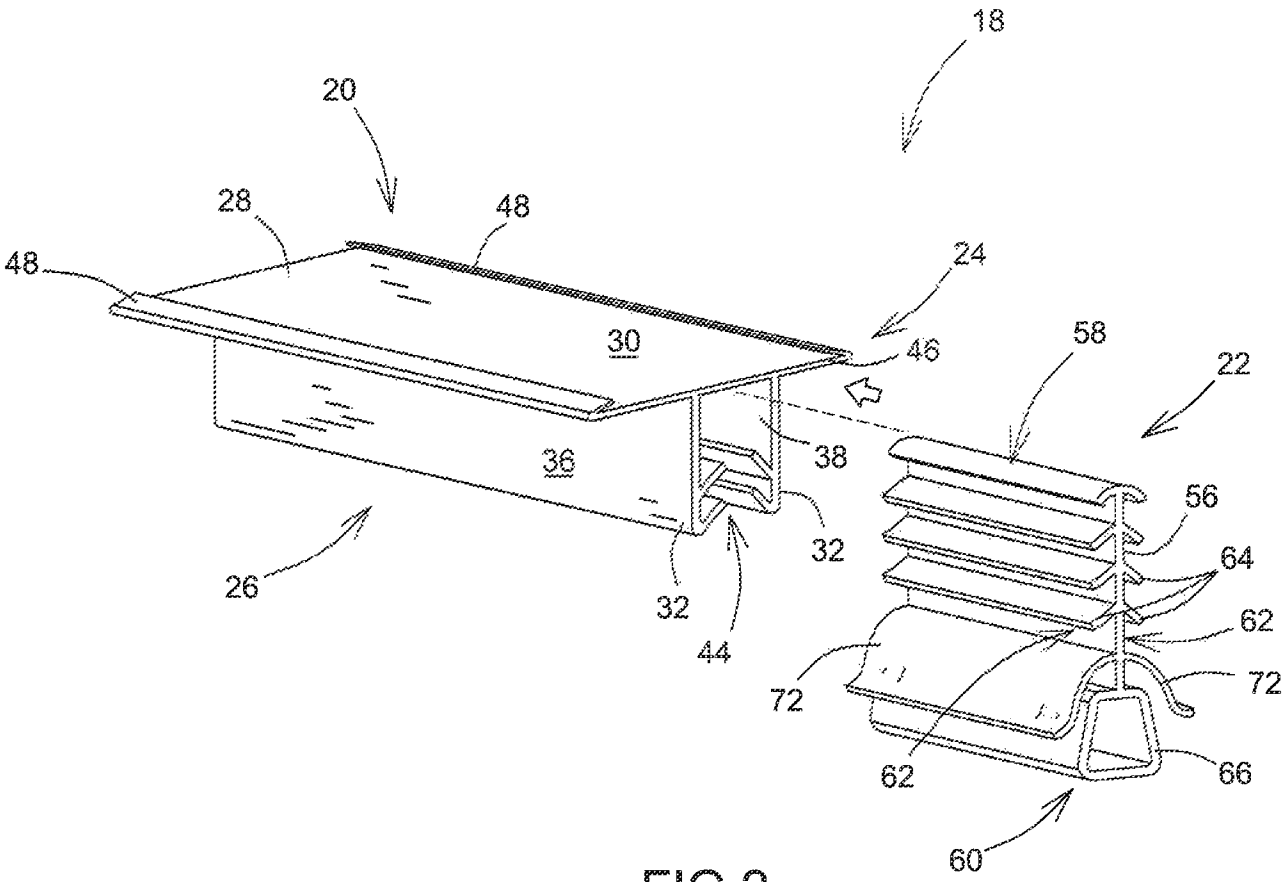
FIG. 2 is a perspective view of the clip assembly for the suspended ceiling of FIG. 1 in a disassembled position in accordance with a non-limiting illustrative embodiment of the present disclosure.
Figure 5:
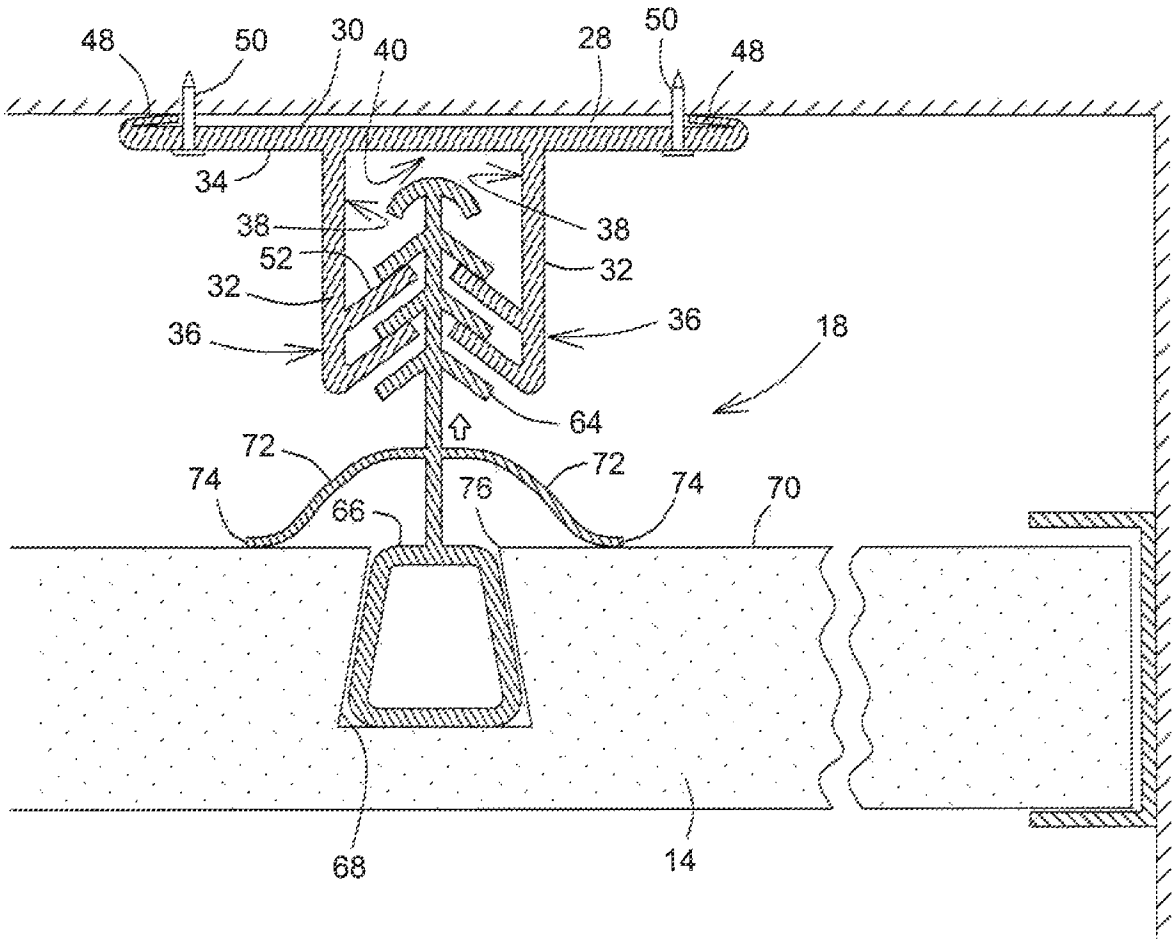
FIG. 5 is a front elevational view of the clip assembly in an assembled position connecting a runner to an overhead structure of the suspended ceiling of FIG. 1, the runner being connected to a lateral wall surface, in accordance with a non-limiting illustrative embodiment of the present disclosure.
Figure 7:
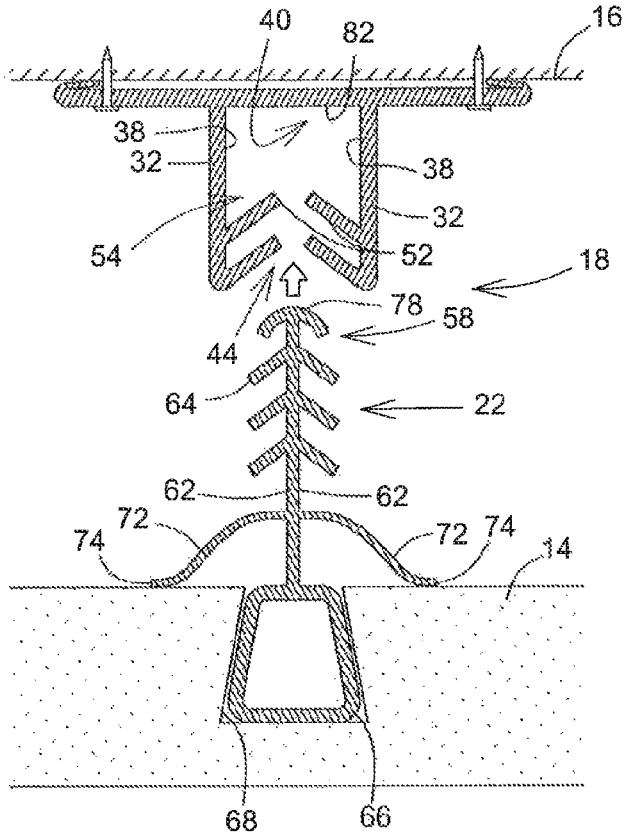
FIG. 7 is a front elevational view of the clip assembly in a disassembled, with the bottom member of the clip assembly connected to a runner and the top member of the clip assembly connected to an overhead structure of the suspended ceiling of FIG. 1 in accordance with a non-limiting illustrative embodiment of the present disclosure.
Figure 8:
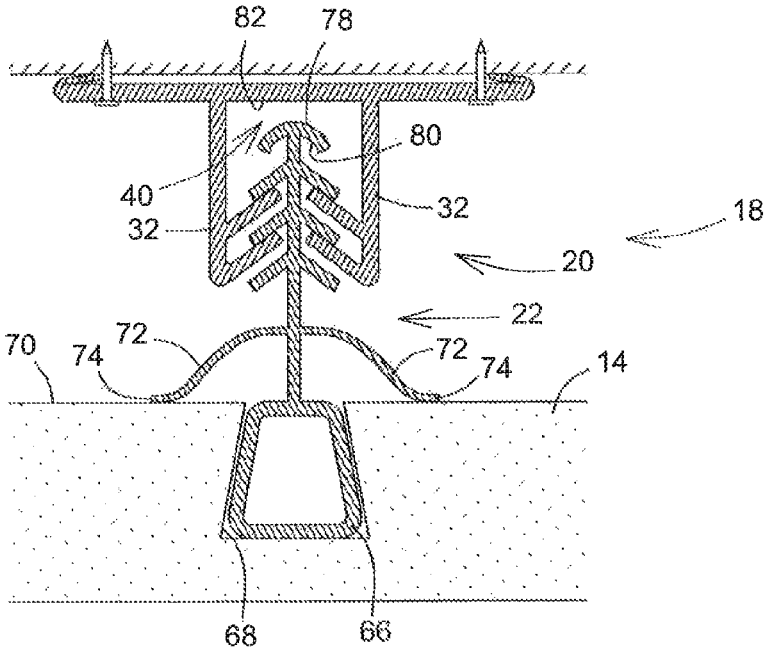
FIG. 8 is a front elevational view of the clip assembly in an assembled position connecting a runner to an overhead structure of the suspended ceiling of FIG. 1 in accordance with a non-limiting illustrative embodiment of the present disclosure.

FIG. 1 shows a modular suspended ceiling structure 10 comprising a plurality ceiling panels 12 mounted to runners 14. As shown in FIGS. 5, 7 and 8, the runners 14 are connected to overhead structures such as beams 16 via clip assemblies 18.

With respect to FIGS. 2, 3, 4 and 5, the clip assembly comprises a top member 20 and a bottom member 22.

The top member 20 includes a top portion 24 and a bottom portion 26. The top portion 24 is defined by an upper wall 28 having a top surface 30 for interfacing with the overhead structure 16. The bottom portion 24 includes a pair of spaced apart lower lateral walls 32 downwardly extending from the underside 34 of the upper wall 28 which is opposite the top surface 30.

The spaced apart lateral walls 32 define respective outer wall surfaces 36 and respective inner wall surfaces 38. The spaced apart inner wall surfaces 38 define a channel 40 therebetween. Moreover, the spaced apart lower lateral walls 32 define front and rear open faces 42 (it should be noted that the terms "front" and "rear" are used herein for convenience and are thus interchangeable) and a bottom opening 44 (see also FIGS. 6 and 7).

The top surface 30 of the upper wall 28 defines a peripheral edge 46 comprising flexible and resilient flaps 48 inwardly extending from the peripheral edge 46 above the top surface 30. When the upper wall 20 is secured to the overhead structure 16 via fasteners 50 for example, the flaps 38 engage the overhead structure 16 and bias the upper wall 28 away from the overhead structure 16 thereby stabilizing the top member 20. As such, when the surface of the overhead structure is uneven the biasing force of the flaps 48 provide for evening out the engagement between the top member 20 and the overhead structure 16 such that the lateral walls 32 are substantially vertical.

The inner walls 38 of the spaced apart lower walls 32 comprise at least one respective inward fin 52 extending therefrom into the channel 40 in an upwardly sloped direction providing for forming a receiving cavity 54 (see FIG. 7) between the inward fin 52 and the inner surface wall 38 it extends from.

Figure 3:
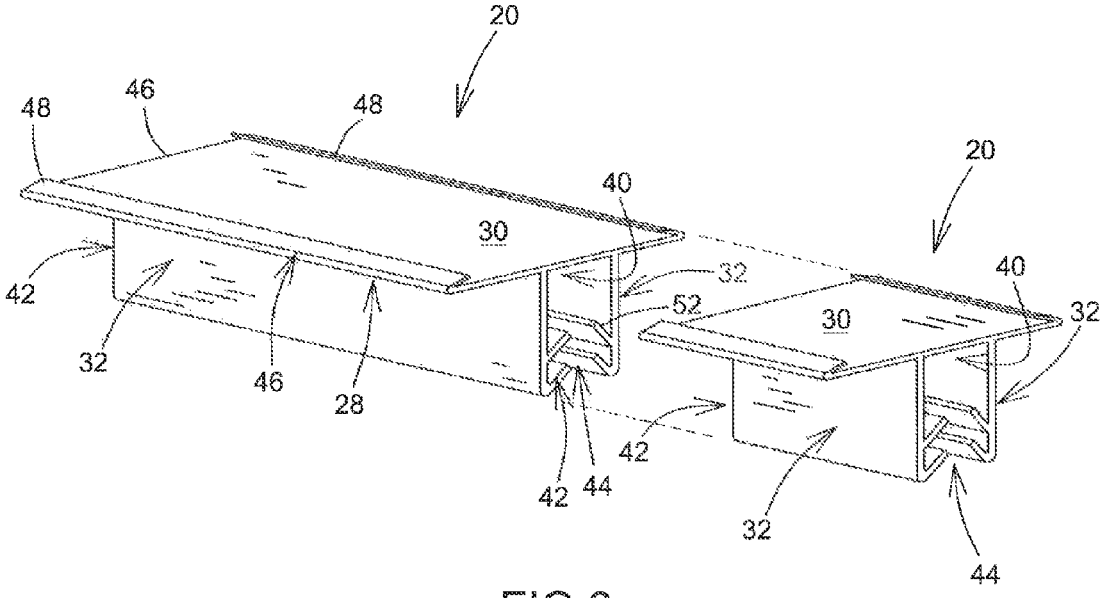
FIG. 3 is a perspective view of two top members of the clip assembly for the suspended ceiling of FIG. 1 in accordance with a non-limiting illustrative embodiment of the present disclosure.

As shown in FIG. 3, the top member 20 of the clip assembly 18 can be provided in various lengths. Still referring to FIG. 3, the clip assembly 18 can comprise two or more top members 20.

The bottom member 22 of the clip assembly 18 comprises a main longitudinal and generally vertical body 56 defining top and bottom end, 58 and 60 respectively and opposite lateral surfaces 62 (see FIG. 7).

Each lateral surface 62 comprises at least one outward fin 64 that extends therefrom in a downwardly sloped direction.

The vertical body 56 and the outward fins 64 extending therefrom are configured to be inserted into the channel 40 via the front or rear face 42 of the top member. In this way, a given lateral surface 62 of the vertical body 56 of the bottom member 22 interfaces with a given inner surface 38 of a given lateral wall 32 of the top member 20 providing a given outward fin 64 of that given lateral surface 62 to interface and slide on a given inward fin 52 of that given inner surface 38. In one non-limiting embodiment, this given inward fin 52 and this given outward fin 64 have complementary sloped structures. In this way, the outward fins 64 are rested or mounted on the inward fins 52 they interface with thereby mounting the bottom member 22 to the top member 20.

Each inner surface 38 of the top member 20 can include more than one inward fin 52 as shown in the Figures; correspondingly, each lateral surface of the bottom member can include more than one outward fin 64. Therefore, the bottom member 22 can be mounted along different positions along the vertical height defines by the channel 40. As such, the height of the clip assembly 18 is adjustable and thus the space between a runner 12 and the overhead structure 16.

When the clip assembly 18 is assembled, the bottom end 60 of the vertical member 56 extends beyond the bottom opening of is secured to the runner 14. The bottom end 60 comprises an insert 66; in the illustrated example the insert 66 comprises a dovetail tubular structure that is fitted into a complementarily configured groove 68 in a surface 70 of the runner 14. In an embodiment, the groove 68 runs all the way to an edge 69 (see FIG. 6) of the runner 14 forming an opening 71 (see FIG. 6) and the insert 66 is slid into the groove 68 for a secure fit thereby mounting the bottom member 22 of the clip assembly 18 to the runner 14.

Each of the lateral surfaces 62 of the bottom member 22 comprise at least one flexible and resilient curved flap member 72 downwardly extending therefrom. Each flap member 72 defines a respective free end 74 thereof for engaging the runner surface 70 when the bottom end 60 is secured thereto thereby stabilizing the clip assembly 18 between the overhead structure 16 the runner 14. The flaps 72 bias the bottom member 22 away from the runner 14 adding to the tension of the insert 66 within the groove 68 which cannot escape from the opening 76 formed in the runner surface 70 thereby further securing the bottom end 60 to runner 14.

With particular reference to FIGS. 7 and 8, the top end 58 of the vertical body 56 comprises an outer top flexible and resilient curved wall 78 with the underside thereof 80 acting as a fin. The upper wall 28 comprises an undersurface 82 (see FIGS. 7 and 8) defined between the spaced apart lower lateral walls 32. In an embodiment, the outer top curved wall 80 provides for engaging the undersurface 82 thereby adding tension to the clip assembly 18 between the overhead structure 16 and the runner 14 further solidifying the connection therebetween.

Figure 4:
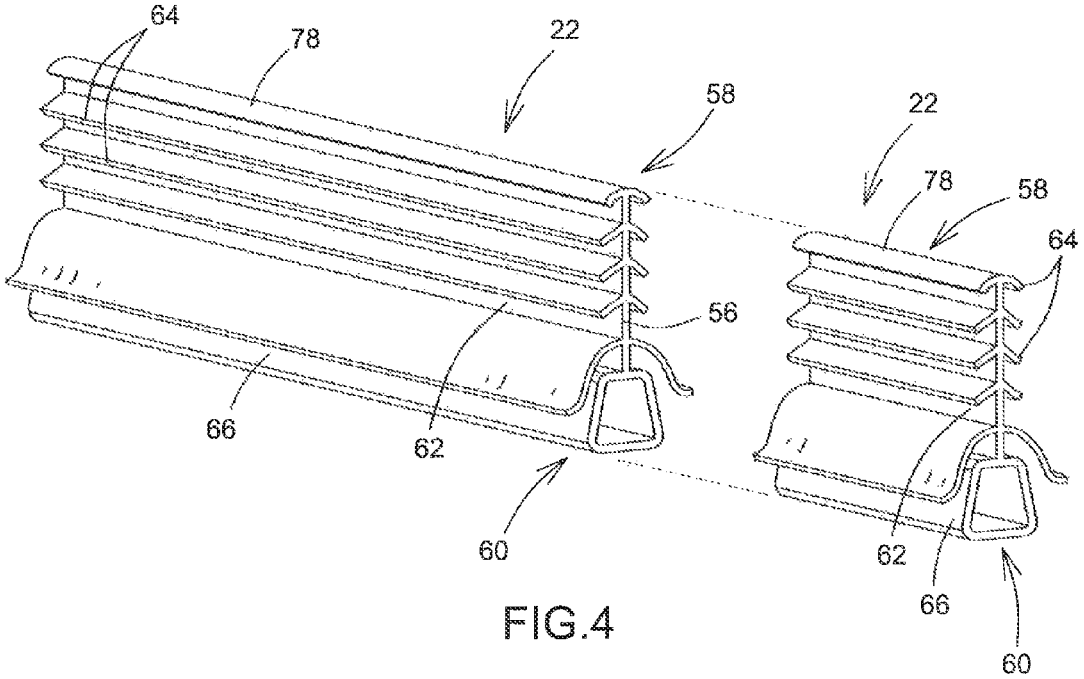
FIG. 4 is a perspective view of two bottom members of the clip assembly for the suspended ceiling of FIG. 1 in accordance with a non-limiting illustrative embodiment of the present disclosure.

As shown in FIG. 4, the bottom member 22 of the clip assembly 18 can be provided in various lengths. Still referring to FIG. 4, the clip assembly 18 can comprise two or more bottom members 22.

As ascertained from the above, there is provided a method for assembling a suspended ceiling, which comprises providing the elements described herein. The method comprises securing the top member 20 of the clip assembly 18 to the overhead structure 16, sliding the bottom member 22 of the clip assembly 18 along the top member 20 and positioning it thereon thereby assembling the clip assembly 18. The bottom member 22 is positioned at a given horizontal position along the horizontal length of the top member 20 as well as a given position along the vertical length of the lateral walls 32.

Figure 6:
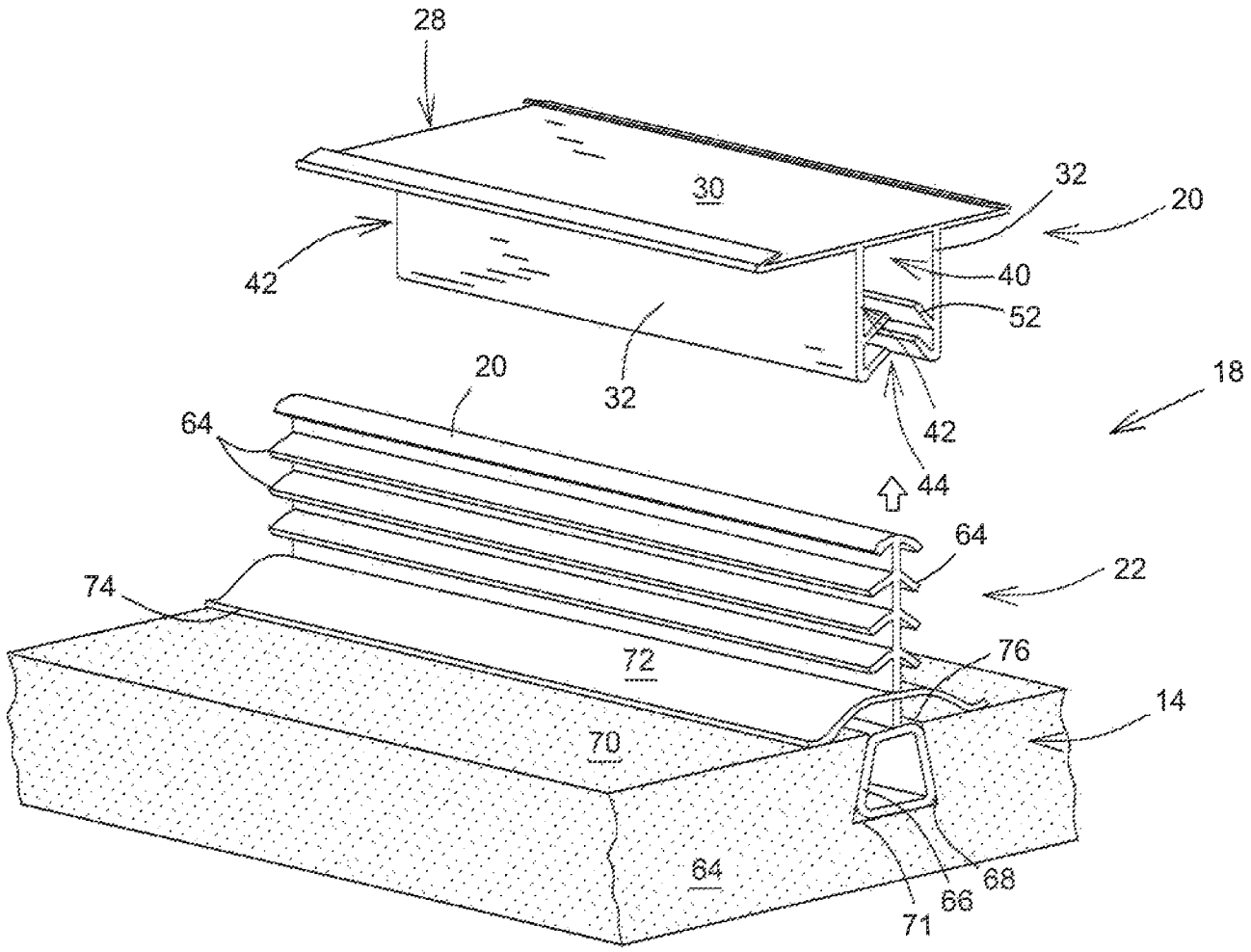
FIG. 6 is a perspective view of the clip assembly in a disassembled position, with the bottom member of the clip assembly connected to a runner of the suspended ceiling of FIG. 1 in accordance with a non-limiting illustrative embodiment of the present disclosure.

In another embodiment, as shown in FIGS. 6, 7 and 8, the top end 58 of the bottom member 22 is used to penetrate the bottom opening 44 of the top member 20 to be inserted within the channel 40. As such, the curved wall 78 is configured to push the inward fins 52 inwardly towards the inner surfaces 38 of the lateral walls 32, the outwards fins 64 consequently push the inward fins 52 towards the inner surfaces 38 they protrude from in order to create a space for entry of the vertical member 56 and the outward fins 64. The deformability and resiliency of the inward fins 52 provides for them to spring back to their original form thereby allowing the outward fins 64 to be mounted on the inward fins 52.

There is also provided a kit for constructing a suspended ceiling comprising elements discussed herein.

The various features described herein can be combined in a variety of ways within the context of the present description so as to provide still other embodiments. It is to be understood that the present description is not limited in its application to the details of construction and parts illustrated in the accompanying drawings and described hereinabove. The description is capable of other embodiments and of being practiced in various ways. It is also to be understood that the phraseology or terminology used herein is for the purpose of description and not limitation. Hence, although the present description has been provided hereinabove by way of non-restrictive illustrative embodiments thereof, it can be modified, without departing from the scope, spirit and nature of the disclosure and appended claims

What is claimed is:

1. A clip assembly for a suspended ceiling, the suspended ceiling comprising at least one ceiling panel and at least one runner, the clip assembly comprising:

a top member comprising:

an upper wall for being secured to an overhead structure, the upper wall comprising a bottom surface and an opposite top surface for interfacing with the overhead structure, the top surface defining a peripheral edge and comprising a pair of flexible and resilient flaps respectively inwardly extending from opposite sides of the peripheral edge and defining respective free ends being spaced above the top surface for engaging the overhead structure to bias the upper wall away from the overhead structure when secured thereto;

a pair of lower spaced apart lateral vertical walls downwardly extending from the upper wall and defining an upper wall portion therebetween, the lateral walls defining front and rear open faces and a bottom opening and comprising respective outer surfaces and inner surfaces defining a channel therebetween;

at least two inward fins extending from each of the inner surfaces into the channel in an upwardly and diagonally sloped direction providing for forming a receiving cavity with the inner surface, the at least two inward fins being spaced apart so as to define an upper fin, a lower fin, a flat vertical lateral surface portion therebetween, and an upper vertical lateral surface portion between the upper fin and the upper wall; and a bottom member comprising:

a main longitudinal and vertical wall body defining a top end, a bottom end for being secured to the runner and opposite lateral surfaces therebetween;

at least two outward fins extending from each of the lateral surfaces of the main longitudinal and vertical body in a downwardly and diagonally sloped direction that is complementary to the upwardly and diagonally sloped direction of the inward fins, the at least two outward fins being spaced apart so as to define a flat vertical lateral wall portion therebetween; and at least one flexible and resilient circularly curved flap member downwardly extending from each of the lateral surfaces of the bottom member and defining a respective free end thereof for engaging a flat top surface of the runner when the bottom end is secured thereto thereby stabilizing the Clip assembly between the overhead structure and the runner, wherein the bottom member is configured to be inserted into the channel via the front or rear open faces providing for each one of the outward fins to be received by a respective one of the receiving cavities and to slide on a respective one of the inward fins and be supported thereon and for the bottom end to extend below the bottom opening thereby mounting the bottom member to the top member so as to connect the runner when the bottom end is secured thereto to the overhead structure when the upper wall is secured thereto.

2. A clip assembly according to claim 1, wherein the bottom end comprises an insertion for being secured within a groove formed on a top surface of the runner, the top surface being generally flat and devoid of any protrusions.

3. A clip assembly according to claim 1, wherein the upper wall is fastened to the overhead structure.

4. A clip assembly according to claim 1, wherein the top end comprises an outer top flexible and resilient curved wall, the upper wall comprising an undersurface defined between the spaced apart lower lateral walls, the outer top curved wall providing for engaging the undersurface.

5. A clip assembly according to claim 1, further comprising a plurality of inward fins and outward fins, each of the plurality of inward fins positioned at a respective height along the vertical length of the channel, each of the outward fins positioned at a respective height along the vertical length of the bottom member, thereby providing for mounting the bottom member at different heights along the vertical length of the top member.

6. A suspended ceiling comprising:

a plurality of runners for being mounted to an overhead structure;

a plurality of panels for being mounted to the plurality of runners; and at least one clip assembly for mounting at least one of the runners to the overhead structure, the at least one clip assembly comprising:

a top member comprising:

an upper wall for being secured to an overhead structure, the upper wall comprising a bottom surface and an opposite top surface for interfacing with the overhead structure, the top surface defining a peripheral edge and comprising a pair of flexible and resilient flaps respectively inwardly extending from opposite sides of the peripheral edge and defining respective free ends being spaced above the top surface for engaging the overhead structure to bias the upper wall away from the overhead structure when secured thereto;

a pair of lower spaced apart lateral vertical walls downwardly extending from the upper wall and defining an upper wall portion therebetween, the lateral walls defining front and rear open faces and a bottom opening and comprising respective outer surfaces and inner surfaces defining a channel therebetween;

at least two inward fins extending from each of the inner surfaces into the channel in an upwardly and diagonally sloped direction providing for forming a receiving cavity with the inner surface, the at least two inward fins being spaced apart so as to define an upper fin, a lower fin, a flat vertical lateral surface portion therebetween, and an upper vertical lateral surface portion between the upper fin and the upper wall; and a bottom member comprising:

a main longitudinal and vertical wall body defining a top end, a bottom end for being secured to the runner and opposite lateral surfaces therebetween;

at least two outward fins extending from each of the lateral surfaces of the main longitudinal and vertical body in a downwardly and diagonally sloped direction that is complementary to the upwardly and diagonally sloped direction of the inward fins, the at least two outward fins being spaced apart so as to define a flat vertical lateral wall portion therebetween; and at least one flexible and resilient circularly curved flap member downwardly extending from each of the lateral surfaces of the bottom member and defining a respective free end thereof for engaging a flat top surface of the runner when the bottom end is secured thereto thereby stabilizing the Clip assembly between the overhead structure and the runner, wherein the bottom member is configured to be inserted into the channel via the front or rear open faces providing for each one of the outward fins to be received by a respective one of the receiving cavities and to slide on a respective one of the inward fins and be supported thereon and for the bottom end to extend below the bottom opening thereby mounting the bottom member to the top member so as to connect the runner when the bottom end is secured thereto to the overhead structure when the upper wall is secured thereto.

7. A suspended ceiling according to claim 6, wherein the bottom end comprises an insertion for being secured within a groove formed on a top surface of the at least one runner, the top surface being generally flat and devoid of any protrusions.

8. A suspended ceiling according to claim 7, wherein the top end comprises an outer top flexible and resilient curved wall, the upper wall comprising an undersurface defined between the spaced apart lower lateral walls, the outer top curved wall providing for engaging the undersurface.

9. A suspended ceiling according to claim 6, wherein the upper wall is fastened to the overhead structure.

10. A suspended ceiling according to claim 6, further comprising a plurality of inward fins and outward fins, each of the plurality of inward fins positioned at a respective height along the vertical length of the channel, each of the outward fins positioned at a respective height along the vertical length of the bottom member, thereby providing for mounting the bottom member at different heights along the vertical length of the top member.

11. A kit for a suspended ceiling comprising, the kit comprising:

at least a pair of runners for being mounted to an overhead structure;

at least one panel for being mounted to the pair of runners; and at least one clip assembly for mounting at least one of the runners of the pair to the overhead structure, the at least one clip assembly comprising:

a top member comprising:

an upper wall for being secured to an overhead structure, the upper wall comprising a bottom surface and an opposite top surface for interfacing with the overhead structure, the top surface defining a peripheral edge and comprising a pair of flexible and resilient flaps respectively inwardly extending from opposite sides of the peripheral edge and defining respective free ends being spaced above the top surface for engaging the overhead structure to bias the upper wall away from the overhead structure when secured thereto;

a pair of lower spaced apart lateral vertical walls downwardly extending from the upper wall and defining an upper wall portion therebetween, the lateral walls defining front and rear open faces and a bottom opening and comprising respective outer surfaces and inner surfaces defining a channel therebetween;

at least two inward fins extending from each of the inner surfaces into the channel in an upwardly and diagonally sloped direction providing for forming a receiving cavity with the inner surface, the at least two inward fins being spaced apart so as to define an upper fin, a lower fin, a flat vertical lateral surface portion therebetween, and an upper vertical lateral surface portion between the upper fin and the upper wall; and a bottom member comprising:

a main longitudinal and vertical wall body defining a top end, a bottom end for being secured to the runner and opposite lateral surfaces therebetween;

at least two outward fins extending from each of the lateral surfaces of the main longitudinal and vertical body in a downwardly and diagonally sloped direction that is complementary to the upwardly and diagonally sloped direction of the inward fins, the at least two outward fins being spaced apart so as to define a flat vertical lateral wall portion therebetween; and at least one flexible and resilient circularly curved flap member downwardly extending from each of the lateral surfaces of the bottom member and defining a respective free end thereof for engaging a flat top surface of the runner when the bottom end is secured thereto thereby stabilizing the Clip assembly between the overhead structure and the runner, wherein the bottom member is configured to be inserted into the channel via the front or rear open faces providing for each one of the outward fins to be received by a respective one of the receiving cavities and to slide on a respective one of the inward fins and be supported thereon and for the bottom end to extend below the bottom opening thereby mounting the bottom member to the top member so as to connect the runner when the bottom end is secured thereto to the overhead structure when the upper wall is secured thereto.

12. A suspended ceiling according to claim 11, wherein the top end comprises an outer top flexible and resilient curved wall, the upper wall comprising an undersurface defined between the spaced apart lower lateral walls, the outer top curved wall providing for engaging the undersurface.

13. A suspended ceiling according to claim 11, further comprising a plurality of inward fins and outward fins, each of the plurality of inward fins positioned at a respective height along the vertical length of the channel, each of the outward fins positioned at a respective height along the vertical length of the bottom member, thereby providing for mounting the bottom member at different heights along the vertical length of the top member.

* * * * *